US005924432A

United States Patent [19]

Thies et al.

[11] Patent Number: 5,924,432

[45] Date of Patent: Jul. 20, 1999

[54] DISHWASHER HAVING A WASH LIQUID RECIRCULATION SYSTEM

[75] Inventors: Edward L. Thies, Tipp City, Ohio; Roger J. Bertsch, Stevensville; Wilbur W. Jarvis, St. Joseph, both of Mich.

[73] Assignee: Whirlpool Corporation, Benton Harbor, Mich.

[21] Appl. No.: 08/710,312

[22] Filed: Sep. 16, 1996

Related U.S. Application Data

[60] Provisional application No. 60/005,694, Oct. 17, 1995.

[51] Int. Cl.[6] ..... B08B 3/02

[52] U.S. Cl. ..... 134/56 D; 134/183; 134/198; 134/174; 137/118.04; 137/118.06; 415/146

[58] Field of Search ..... 134/183, 198, 134/560, 570, 174; 137/118.02, 118.04, 118.06, 119.01; 239/572; 415/146; 417/315, 442

[56] References Cited

U.S. PATENT DOCUMENTS

| | | | |
|---|---|---|---|
| 1,637,376 | 8/1927 | Gibney . | |
| 2,943,633 | 7/1960 | Marmo et al. | 134/174 |
| 3,160,164 | 12/1964 | Constance et al. | 134/176 |
| 3,261,554 | 7/1966 | Perl | 239/252 |
| 3,906,967 | 9/1975 | Bergeson | 417/315 |
| 4,319,599 | 3/1982 | Dingler et al. | 134/104 |
| 4,509,687 | 4/1985 | Cushing | 239/245 |
| 4,600,361 | 7/1986 | Bianco | 415/146 |
| 4,679,983 | 7/1987 | Pietryk et al. | 415/146 |
| 4,741,353 | 5/1988 | Milocco | 137/119 |
| 4,874,298 | 10/1989 | Mainardi et al. | 417/315 |
| 4,989,786 | 2/1991 | Kranzle et al. | 239/240 |
| 5,264,043 | 11/1993 | Milocco | 134/25.2 |
| 5,486,089 | 1/1996 | Chung | 415/146 |

FOREIGN PATENT DOCUMENTS

| | | | |
|---|---|---|---|
| 1049066 | 12/1953 | France | 415/146 |
| 1142593 | 9/1957 | France | 415/146 |
| 1088813 | 11/1958 | Germany | 415/146 |
| 3442907 | 6/1986 | Germany | 415/146 |
| 2199080 | 6/1988 | United Kingdom | 415/146 |

OTHER PUBLICATIONS

European Patent 501,109, Sep. 1992.

*Primary Examiner*—Frankie L. Stinson
*Attorney, Agent, or Firm*—Joel M. Van Winkle; Andrea Powers Denklau; Thomas J. Roth

[57] ABSTRACT

A dishwasher having a fluid recirculation system which operates in a wash mode for spraying liquid onto objects supported on dishwasher upper and lower racks. The dishwasher includes a pump having a pump impeller disposed within a pump chamber for supplying wash liquid to first and second spray devices, associated with the lower rack and upper racks, respectively. The pump impeller draws wash liquid into the pump chamber and imparts a rotary motion to the wash liquid disposed in the pump chamber. A rotatable diffuser or flow director having a plurality of vanes extending into the pump chamber selectively directs the rotating wash liquid toward the spray devices and thereby controls wash liquid recirculation within the dishwasher responsive to the rotational motion of the wash liquid in the pump chamber.

38 Claims, 7 Drawing Sheets

DISHWASHER HAVING A WASH LIQUID RECIRCULATION SYSTEM

This application claims the benefit of U.S. provisional application Ser. No. 60/005,694 filed on Oct. 17, 1995.

BACKGROUND OF THE INVENTION

This invention relates generally to a dishwasher having a selectively controllable wash liquid recirculation system and more specifically to a dishwasher having a rotatable flow director or diffuser for directing the flow of wash liquid recirculated within the dishwasher.

Generally, a dishwashing machine has a wash cavity supporting an upper and lower wash rack wherein a horizontally rotatable lower spray arm is disposed beneath the lower rack and an upper spray arm is disposed below the upper rack. Alternative to the upper spray arm, a center, telescopically mounted tube extending upwardly from the lower spray arm may be provided. A wash pump recirculates wash liquid throughout the wash chamber by drawing wash liquid from the wash cavity sump and supplying wash liquid to the upper and lower spray arms such that the spray arms direct wash liquid spray through nozzles to the dishes supported by the upper and lower racks, respectively.

Prior art dishwashers have several limitations or problems to which the present invention is directed.

One limitation is that dishwashers typically have spray arms which rotate under the reactive force of the liquid discharged from the arm. This requires that at least one, and typically two, spray arm nozzles must be configured to provide the required reactive force to ensure proper spray arm rotation rather than being configured to provide the optimum spray pattern for optimum washing results. Moreover, as a result of the fixed nozzle design, the spray arms always rotate in the same direction when the pump supplies wash liquid to the spray arms. This results in a constant spray pattern onto dishes supported on the upper and lower racks.

Another common shortcoming in dishwasher designs is the problem of soil redeposition on the clean dishes during drain, which is most evident in a reversible pump system wherein a centrifugal soil separator is used in conjunction with a pump driven by a reversible pump. In a first motor direction, a wash impeller of the pump operates to supply wash liquid to the wash arms and pump wash liquid through a soil settling chamber such that soils are removed from the recirculating wash liquid. In a second motor direction, a drain impeller of the pump operates to pump wash liquid out of the wash cavity through a drain hose.

In this configuration, during drain mode operation, the wash impeller also is rotated, there being a single motor for driving both impellers. Although the wash impeller's effectiveness is greatly reduced in the reverse motor direction, the wash impeller still operates to pump a small amount of wash liquid through the wash arms during the drain mode. When the motor is reversed, causing the pump to transition from the wash mode to the drain mode, dynamic changes in the fluid flow through the sump of the wash cavity stir up soils. These soils are pumped, by the action of the wash impeller during the drain mode, through the wash arms where they may be redeposited onto dishes. As the wash liquid is pumped to drain, the wash impeller is eventually starved, preventing further pumping of wash liquid through the spray arms and leaving the soils on the dishes.

Yet another limitation in dishwasher design is the amount of hot water required to adequately operate the dishwasher pump system. Prior art dishwasher pump systems generally are configured to supply wash liquid simultaneously through both the upper and lower spray arms during the wash cycle. To adequately supply wash liquid to both of the spray arms simultaneously, a flow rate between 30–40 GPM is typical. As is readily understood by one skilled in the art, enough water must be provided to keep the pump primed while providing this flow rate.

Increasingly, the appliance industry is under pressure to reduce energy consumption. Since one of the primary factors in dishwasher energy usage is the amount of hot water used, it would be advantageous to reduce the flow rate requirements of the dishwasher such that less hot water may be used.

U.S. Pat. No. 4,509,687 discloses a system for alternatingly diverting the flow of wash liquid between a rotating spray arm and an extendable top spray tower. A gear system is provided wherein a driving gear drives a fixed reaction gear to control the rotation of a valve which directed liquid flow between the spray arm and the tower. This system is relatively complicated and results in an automatic and non-selectively controllable oscillation between suppling wash liquid to the spray arm and spray tower.

U.S. Pat. No. 4,094,702 discloses a dishwasher system having an upper and lower spray arm wherein a valve is provided which may be manually operated for allowing independent control of the washing liquid flow to the respective upper and lower spray arms. This system has the significant disadvantage of requiring the user to manually select the control of wash liquid flow.

SUMMARY OF THE INVENTION

Accordingly, responsive to the above described problems, it would be an improvement in the art to provide a recirculation system for a dishwasher for reducing the flow requirements by selectively alternating the supply of water between the upper and lower spray arms. This would provide a washing system for a dishwasher wherein the amount of water used is substantially reduced while maintaining the effective washing ability of the dishwasher.

It would also be an improvement in the art for a dishwasher utilizing a reversible motor type centrifugal pump, if wash liquid flow through the spray arms is cut off during drain such that soils in the sump are pumped out of the wash cavity when the drain is initiated rather than being deposited onto the dishes supported on the racks in the wash cavity.

It would also be beneficial to the wash performance if the spray pattern onto the dishes varied as by periodically changing the direction of the rotation of the spray arm. It would be an improvement in the art, therefore, to provide a system wherein the spray arm may be periodically rotated first in one direction and then in the reverse direction to vary the spray pattern of the wash liquid contacting the dishes in the dishwasher.

According to the present invention, the foregoing and other improvements in the art are attained by a dishwasher having a fluid recirculation system which operates in a wash mode for spraying liquid onto objects supported on dishwasher upper and lower racks. The dishwasher includes a pump having an impellor disposed in a pump chamber. The impeller draws wash liquid into the pump chamber and imparts a rotary motion to the wash liquid disposed in the pump chamber. A first spray device and a second spray device, associated with the lower rack and upper rack respectively, are fluidly interconnected with the pump. A rotatable diffuser or flow director having a plurality of vanes extending into the pump chamber selectively directs wash liquid from the pump chamber to the spray devices wherein the diffuser selectively controls wash liquid recirculation within the dishwasher.

In a first embodiment, the diffuser or flow director comprises a valve which is supported for rotational movement between a plurality of angular positions in response to the rotational direction of the pump impeller. The valve is configured such that in a first position wash liquid is supplied to the first spray device through a first opening and in a second position wash liquid is supplied to the second spray device through a second opening.

In a second embodiment, the dishwasher is provided with a spring for biasing the valve toward a first angular position such that wash liquid is directed to the second spray device. The system includes a variable speed motor for driving the wash impeller wherein at a first motor speed the valve directs wash liquid to the upper rack. At a second, higher motor speed the torque applied to the plurality of vanes by the rotating wash liquid overcomes the spring bias and the valve is positioned in a second angular position for supplying wash liquid to the lower rack.

In a third embodiment, the dishwasher is provided with a clutch system including a plurality of stops and ratchet teeth. The diffuser or flow director operates as a valve and has a tab wherein the stops and ratchet teeth are positioned in the path of the tab when the diffuser is rotated. The pump may be selectively energized for positioning tab adjacent one of the stops or ratchet teeth such that the valve may be controlled to be positioned in three or more angular orientations.

In a fourth embodiment of the present invention, a dishwasher is provided having a pump disposed at the bottom of a wash cavity. A pump cover or conduit is provided between the pump and a spray device or spray arm. A valve having an axis of rotation within the conduit selectively closes the pump outlet opening in response to the pump impeller direction of rotation.

In a fifth embodiment of the present invention, the dishwasher includes a wash arm device fluidly interconnected with a pump chamber for spraying wash liquid onto the dishes disposed in the wash chamber. A rotatable impeller is disposed in the pump chamber for rotatably driving wash fluid within the pump chamber. A diffuser or flow director having a vane extending into the pump chamber directs wash liquid to the wash arm. The diffuser is inter-connected to the wash arm and imparts a rotation to the wash arm in response to the rotating action of the wash arm such that when the pump impeller is rotated in a first direction the wash arm rotates in a like direction and when the pump impeller is rotated in a reverse second direction, the wash arm rotates in the like second direction.

DESCRIPTION OF THE PREFERRED EMBODIMENTS

Figure 1:
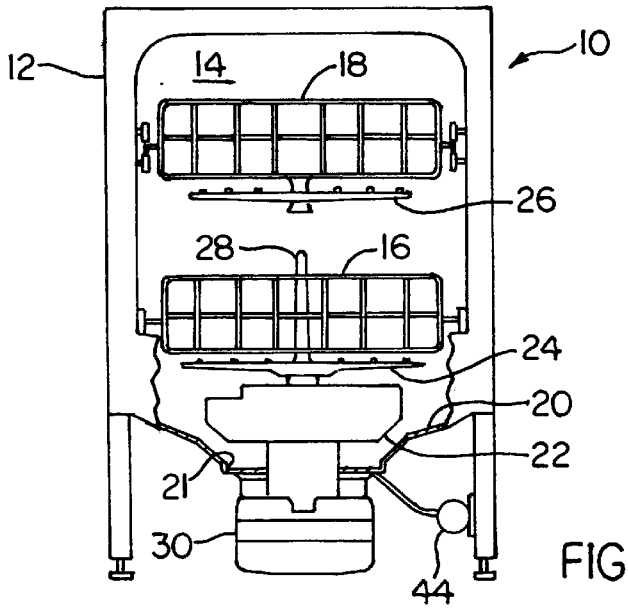
FIG. 1 is a front elevational view, partially cut away and with the door removed, of an automatic washer employing a wash liquid distribution system in accordance with the present invention.

In accordance with the invention as shown in the drawings, and particularly as shown in FIG. 1, an automatic dishwasher, generally designated 10, includes a tub 12 defining a dishwashing cavity or wash chamber 14. Within the wash chamber 14 are a lower dishrack 16 and an upper dishrack 18, which are adapted to receive and support dishes or other items to be washed within the chamber 14. The tub 12 has a bottom wall 20 which gradually slopes to a center low point 21. A soil separator and pump assembly 22 is centrally located relative to the bottom wall at the center low point. A first spray device 24, disposed below the lower dishrack 16, extends from an upper portion of the pump assembly 22 while a second spray device 26 is supported below the upper dishrack 18.

The first and second spray devices 24 and 26 are preferably configured as spray arms as shown. Alternatively, as is well-known in the art, the second spray device could be a center, telescopically mounted tube (not shown) extending upwardly from the first spray device or lower spray arm 24 wherein the center tube includes nozzles for directing wash liquid spray jets against the dishes supported by the upper rack. For ease of understanding, the spray devices will be hereinafter referred to as upper and lower spray arms.

During operation, the pump assembly draws wash liquid from the center low point 21 of the tub and supplies a portion of wash liquid to the lower spray arm 24 and a portion of wash liquid to the upper spray arm 26 through a center post 28. In this fashion, wash liquid is supplied to both the upper and lower spray arms, 26 and 24 respectively, whereby wash liquid spray is directed against the dishes supported on the dishracks.

Figure 2:
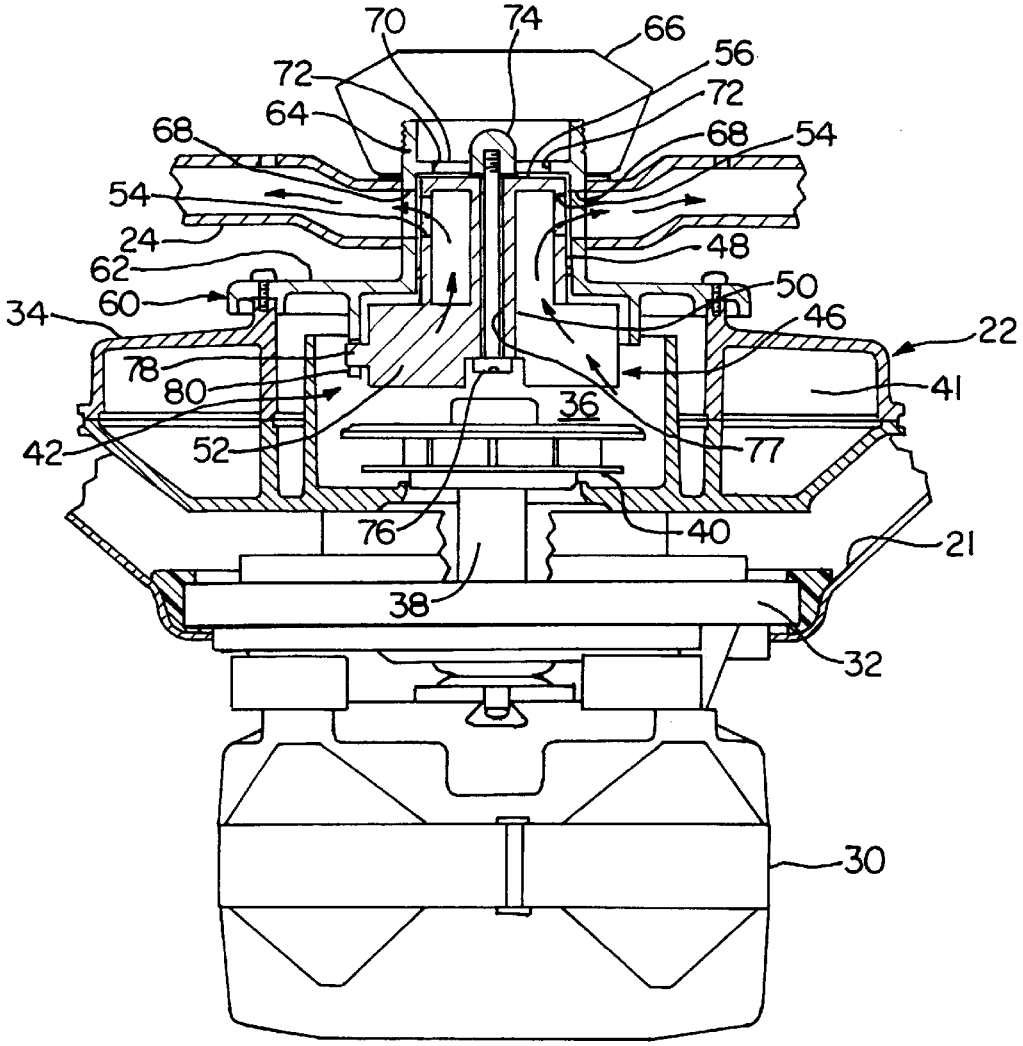
FIG. 2 is a sectional view of a first embodiment of a pump system of FIG. 1, shown with the pump operating in a first direction.

Referring now to FIG. 2 in combination with FIG. 1, the soil separator and pump assembly 22 generally comprises a reversible motor 30 secured to a pump base 32 wherein the pump base is sealably supported within the center low point 21 of the tub. Extending upwardly from the pump base 32 is a soil separator and pump housing 34 defining a pump chamber 36. An output shaft 38 drivingly supports a centrifugal wash impeller 40 within the pump chamber 36.

The soil separator and pump assembly 22 is contemplated to be similar to the systems disclosed in either U.S. Pat. No. 4,319,599, to Dingier et al., issued Mar. 16, 1982, or U.S. Pat. No. 5,165,433, to Meyers, issued Nov. 24, 1992, both of which are owned by the assignee hereof and which are herein incorporated by reference. Generally, the Dingier et al. reference is directed to a centrifugal soil separator system while the Meyers reference contemplates an improvement to Dingler et al. by incorporating a filtering function along with a centrifugal soil separator system. The present invention may be beneficially incorporated into both of these systems as well as other pump systems for dishwashers. For convenience and clarity, however, the present invention is shown in combination with a soil settler system according to Dingier et al.

During pump operation, wash liquid is drawn upwardly by the wash impeller 40 into the pump chamber 36. The wash liquid in the pump chamber is driven in a rotating or swirling fashion by the rotation of the wash impeller. A small portion of the rotating wash liquid in the pump chamber is supplied to a soil separation chamber 41 for removing soils from the recirculating wash liquid. The large majority of rotating wash liquid in the pump chamber, however, is directed by a flow director or diffuser assembly 42 toward the spray arms 24 and 26 wherein the rotational action of the wash liquid is translated into a positive pressure such that the spray arms are primed and wash liquid is sprayed through the spray arms onto the dishes.

In contrast to the Dingler et al. reference, the present invention contemplates a pump system operable in a wash mode in both directions of motor rotation. Accordingly, the wash impeller 40 is designed to effectively pump wash liquid in both directions of rotation. When the motor 30 operates in a first direction, the wash liquid in the pump chamber 36 rotates or swirls in a clockwise fashion when viewed from above in FIG. 2 and the diffuser assembly 42 translates the swirling action into a positive pressure. Similarly, when the motor 30 operates in a second direction, the wash liquid in the pump chamber swirls or rotates in a counter-clockwise direction and the diffuser assembly 42 translates the swirling action into a positive pressure. When it is desired to operate the dishwasher in a drain mode, the wash motor 30 is deenergized and a conventional drain pump 44 is energized for draining wash liquid out of the tub 14 through the soil separator chamber 41.

Figure 3:
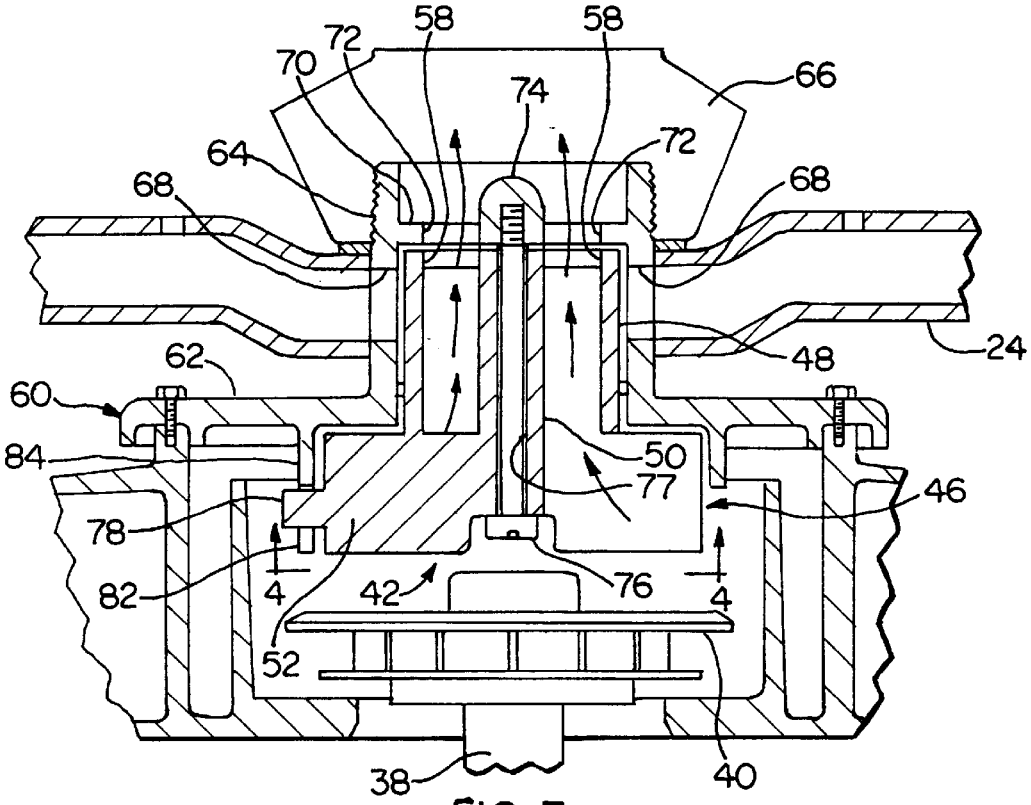
FIG. 3 is a sectional view of the pump system of FIG. 2, shown with the pump operating in a direction opposite to the direction of FIG. 2.
Figure 4:
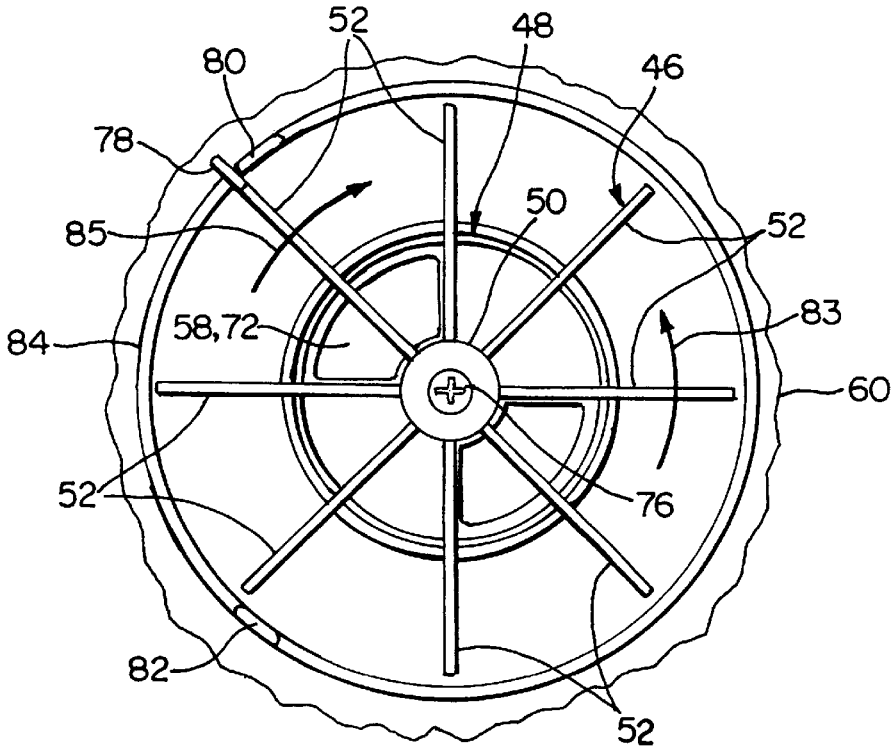
FIG. 4 is a view taken along lines 4—4 of FIG. 3.

Referring now to FIGS. 2–4, the details of the present invention are shown. The flow director or diffuser assembly 42 includes a valve body 46 having a cylindrical portion 48 disposed about a center hub 50 and further having a plurality of vanes 52 extending downwardly from the cylindrical portion 48. The cylindrical portion 48 of the valve body 46 is provided with openings 54 symmetrically positioned about the cylindrical portion 48. Preferably, the cylindrical portion 48 includes two oppositely facing openings 54, each having an arc angle of approximately 90°. The cylindrical portion 48 further includes a top surface 56 having openings 58 symmetrically positioned about the the center hub 50. Preferably, two oppositely facing, 90° sectional openings 58 are provided.

The valve body 46 is supported for limited rotational movement by a cover 60 which is secured to the top of the pump housing 34. The cover 60 includes a flat annular portion 62 and a conduit portion 64. The lower spray arm 24 is disposed about the center portion 64 and is rotatably secured in position by an upper spray arm feed boot 66, which threadingly engages the top of the conduit portion 64. The conduit portion 64 of the cover 60 is provided with openings 68, symmetrically positioned about the center portion 64. Preferably the center portion 64 includes two oppositely faced openings 68, each having an arc angle of approximately 90°. The conduit portion 64 further includes a top wall 70 which includes two opposite, sectional, openings 72 symmetrically positioned about a center boss 74. The openings 68 and 72 on the cover 60 are configured to be substantially similar in size, shape and number to the openings 54 and 58 provided on the valve body 46.

The cylindrical portion 48 of the valve body 46 is received into the conduit portion 64 of the cover 60. The valve body 46 is rotatably secured to the cover 60 by a threaded fastener 76, such as a shoulder screw, which extends through a bore hole 77 in the center hub 50 and screws into the center boss 74. The cylindrical portion 48 of the valve body 46, therefore, may rotate within the center portion 64 of the cover 60.

As shown in FIG. 4, rotation of the valve body 46 relative to the cover 60, however, is limited by the interference between a tab 78, extending from one of the the vanes 52, and stops 80 and 82, provided on an annular wall 84 downwardly extending from the cover 60. The valve body 46 can rotate, therefore, between a first position where tab 78 engages stop 80 and a second position where tab 78 engages stop 82.

During operation, the pump motor 30 can be controlled to drive the impeller 40 in a first direction 83, creating a clockwise rotating action of wash liquid within the pump chamber 36. The vanes 52 of the valve body 46 extend into the pump chamber 36 and, responsive to the swirling action of the wash liquid, rotate the valve body 46 until tab 78 engages stop 80. Moreover, as described above, the vanes 52 convert the swirling action of the wash liquid into a positive pressure. As illustrated in FIG. 2, when the valve body 46 is rotated in the first direction 83, the openings 54 on the valve body 46 align with the openings 68 of the cover 60 while the openings 58 of the valve body and openings 72 of the cover are not in alignment. In this fashion, during rotation of the pump impeller 40 in the first direction 83, wash liquid is supplied, under the positive pressure generated by the vanes 52, through openings 54 and 68 to the lower spray arm 24, while no wash liquid is supplied to the upper spray arm 26.

Reversing the direction of the pump motor 30 and driving the pump impeller 40 in a second direction 85 results in a counter-clockwise swirling of wash liquid in the pump chamber 36. Responsive to the counter-clockwise swirling of wash liquid, the vanes 52 drive the valve body 46 until tab 78 engages stop 82. As illustrated in FIGS. 3 and 4, when the valve body 46 is rotated in the second direction 85, the openings 58 of the valve body 46 align with the openings 72 of the cover while the openings 54 on the valve body 46 and the openings 68 of the cover 60 are not in alignment. In this fashion, during rotation of the pump impeller 40 in the second direction 85, wash liquid is supplied, under the positive pressure generated by the vanes 52, through openings 58 and 72 to the upper spray arm 24, while no wash liquid is supplied to the lower spray arm 26.

As shown and described, therefore, the present invention provides a system for supplying wash liquid to the lower spray arm 24 when the pump is operated in one direction and for alternatively supplying the upper spray arm 26 with wash liquid when the pump is operated in the reverse direction.

Figure 5:
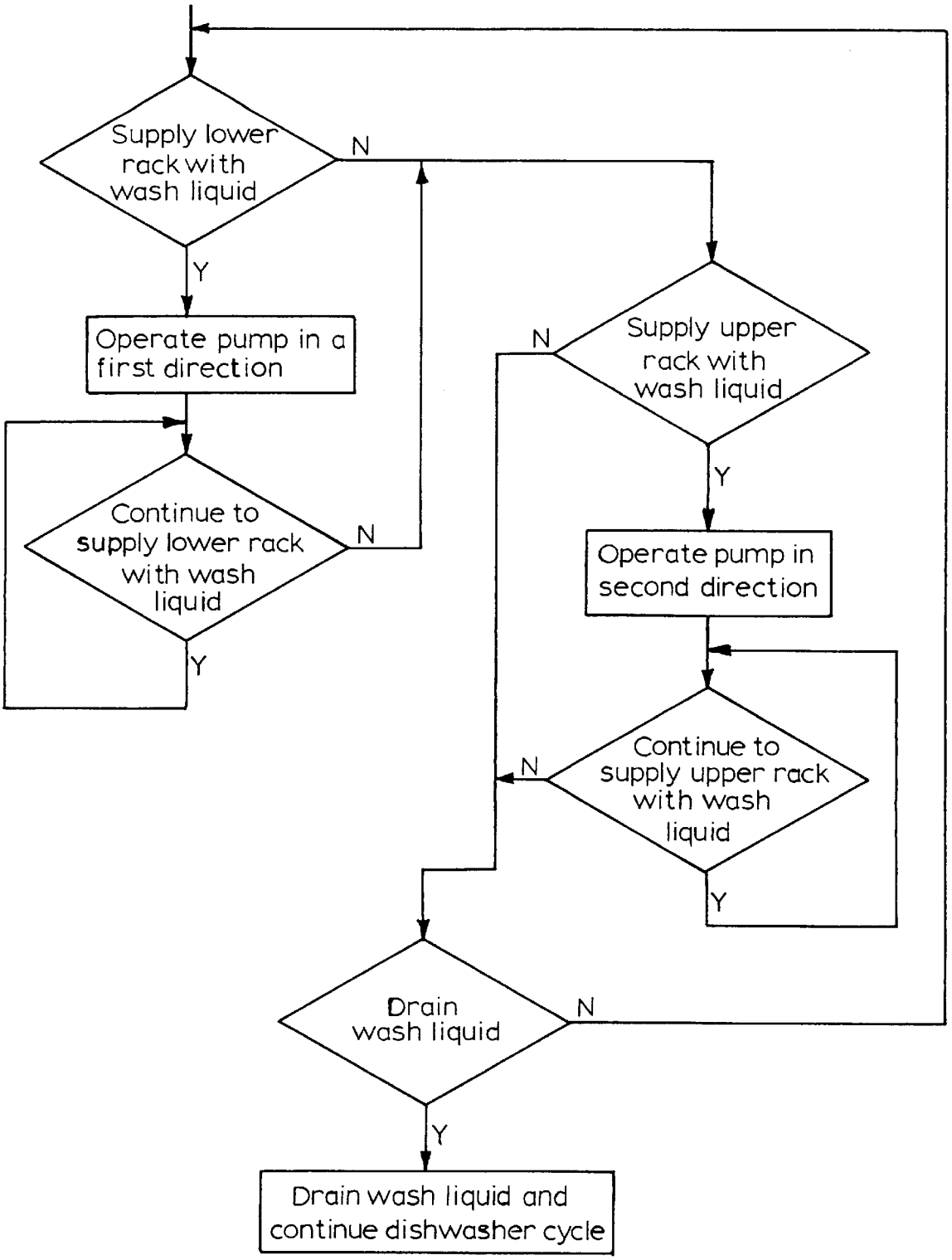
FIG. 5 is a flow chart showing the control logic for selectively directing wash liquid to either the upper spray arm or the lower spray arm in the first embodiment.

FIG. 5 is a flow chart illustrating the manner in which the present invention can be selectively controlled to supply wash liquid exclusively to either the upper or lower spray arm or in any alternating pattern which is desired or yields beneficial results. If wash liquid is to be supplied only to the lower rack 16, the pump can be operated in the first direction 83. If wash liquid is to be supplied only to the upper rack 18, the pump can be operated in the second direction 85. Moreover, any predetermined pattern of alternatingly supplying wash liquid to the upper and lower dishracks 18 can be achieved by controlling the rotational direction of the pump.

Figure 6:
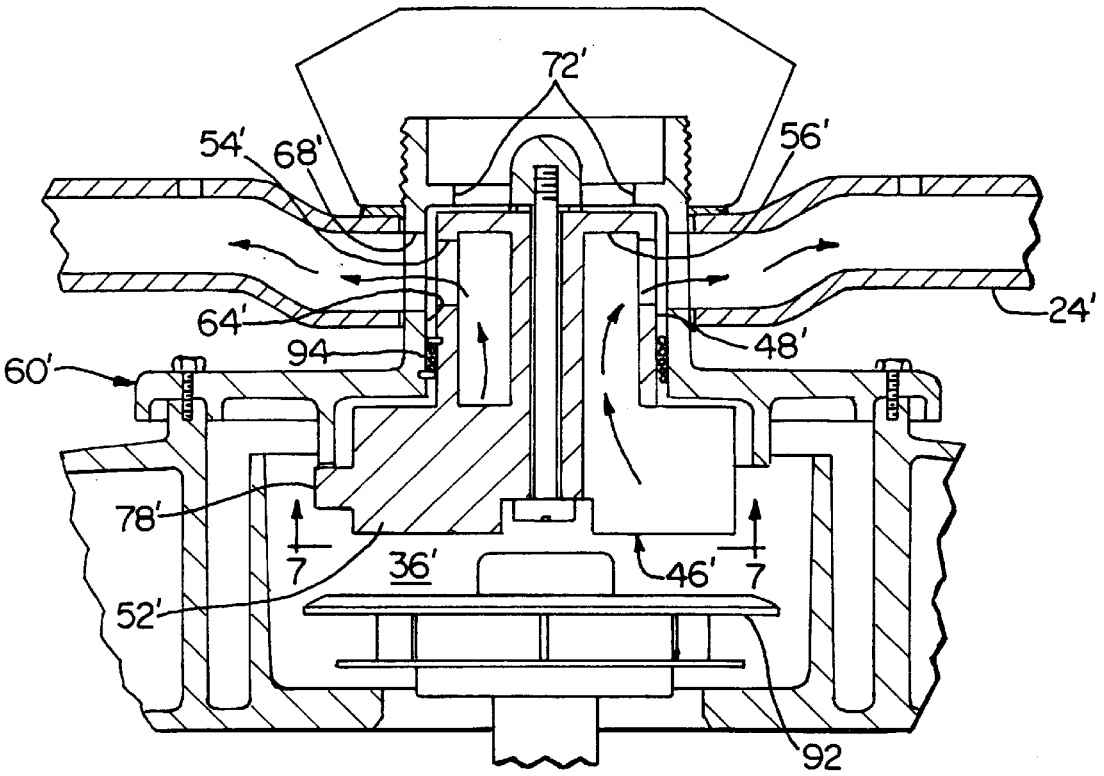
FIG. 6 is a sectional view of a second embodiment of the present invention.
Figure 7:
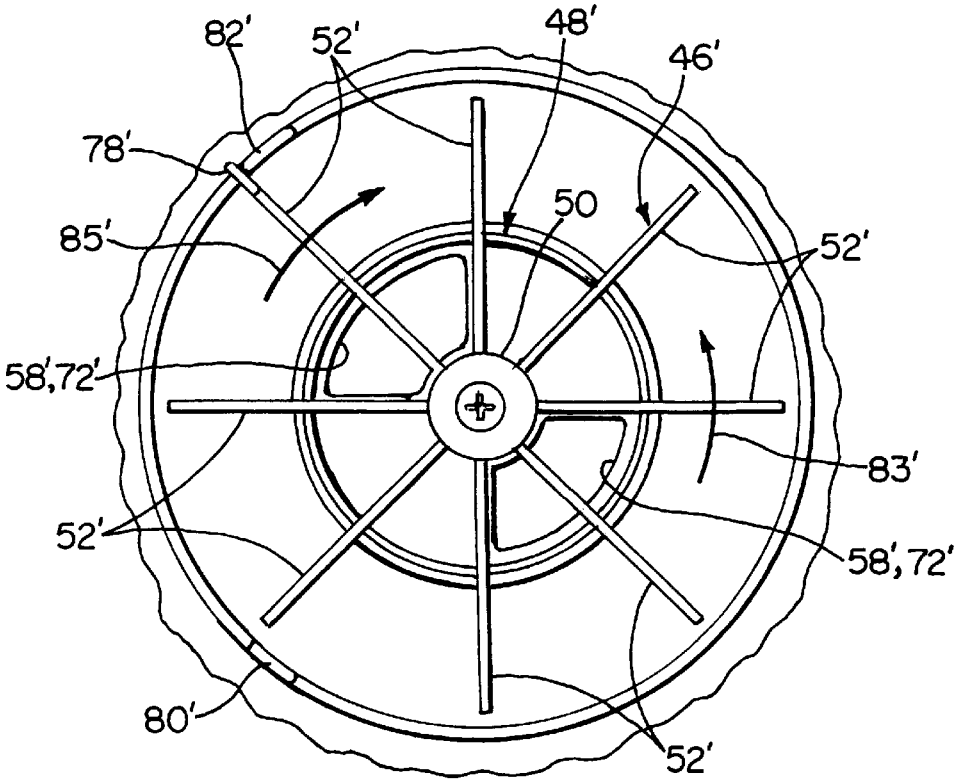
FIG. 7 is a view taken along lines 7—7 of FIG. 6.

Referring now to FIGS. 6 and 7, a second embodiment of the present invention is shown. In this embodiment, the pump system is configured to be operable in a wash mode when the pump motor (not shown) is driven in a first direction and operable in a drain mode when the pump motor is driven in a second direction. Accordingly, similar to the pump system of Dingler et al., the pump system includes a pump impeller 92 and a drain impeller (not shown), supported on a single motor output shaft. In this configuration, therefore, no separate drain pump is required. Moreover, in this second embodiment, the motor is a reversible, variable speed motor.

As shown, the valve body 46' and cover 60' are substantially identical to the previously described valve body 46 and cover 60. During operation in the wash mode, when the motor is driven at a first predetermined speed in a first direction 83', the impeller 92 drives the wash liquid in the pump cavity 36' in a swirling fashion which acts on the vanes 52' and urges the valve body 46' to rotate in the first direction 83'. However, a torsion spring 94 is provided, positioned within the annular clearance between the cylindrical portion 48' of the valve body 46' and a conduit portion 64' of the cover 60' and biases the valve body 46' to rotate in a second direction 85' such that a tab 78' engages a stop 82'.

The spring 94 is designed such that the spring force urging the valve body 46' in the second direction 85' exceeds the rotational force imparted to the valve body 46' by the swirling wash liquid when the motor is driven at a first predetermined speed, such that the tab 78' remains adjacent the stop 82'. In this fashion, wash liquid is supplied through aligned openings 58' and 72' to the upper spray arm when the motor drives the impeller at the first predetermined speed.

When it is desired to supply wash liquid to the lower spray arm 24', the motor speed is increased such that the motor 90 is operated at a second predetermined speed, greater than the first predetermined speed. Correspondingly, this increases the rotational speed of the wash liquid swirling within the pump chamber 36'. The increased rotational speed of the wash liquid within the pump chamber 36' exerts on the valve body 46' a torque, greater than when the motor is driven at the first predetermined speed, which overcomes the spring force exerted by the spring 94. Accordingly, the valve body 46' rotates until the tab 78' engages stop 80' such that wash liquid is supplied to the lower spray arm 24'.

It can be seen, therefore, that the second embodiment of the present invention, shown here in FIGS. 6 and 7, provides a system for supplying wash liquid to the upper spray arm when the pump is operated at a first predetermined speed and for alternatively supplying the lower spray arm 24' with wash liquid when the pump is operated at a greater rotational speed. In this fashion, the second embodiment, like the first embodiment, provides for selective control to supply wash liquid exclusively to either the upper or lower spray arm or in any alternating pattern which is desired or yields beneficial results.

Figure 10:
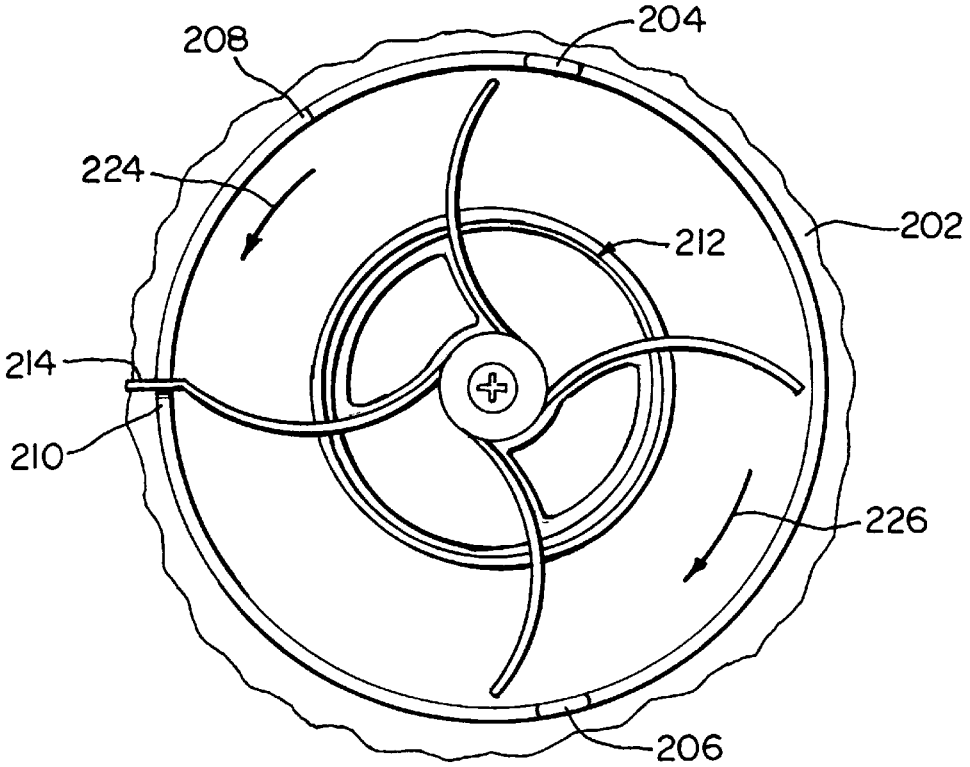
FIG. 10 view taken along lines 10—10 of FIG. 9.
Figure 8:
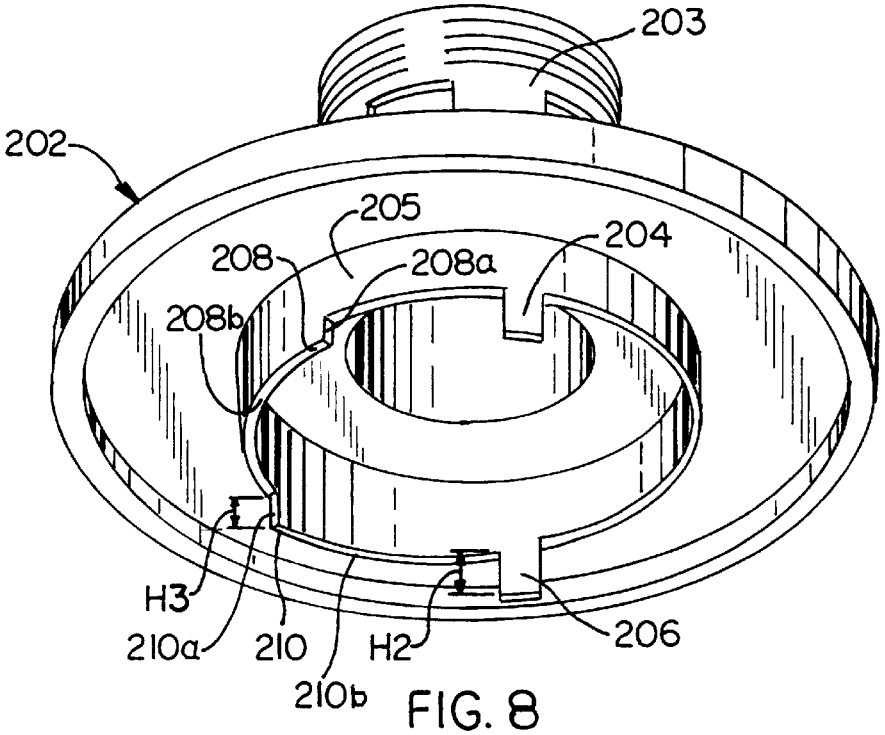
FIG. 8 is a perspective view of a pump cover of a third embodiment of the present invention.
Figure 9:
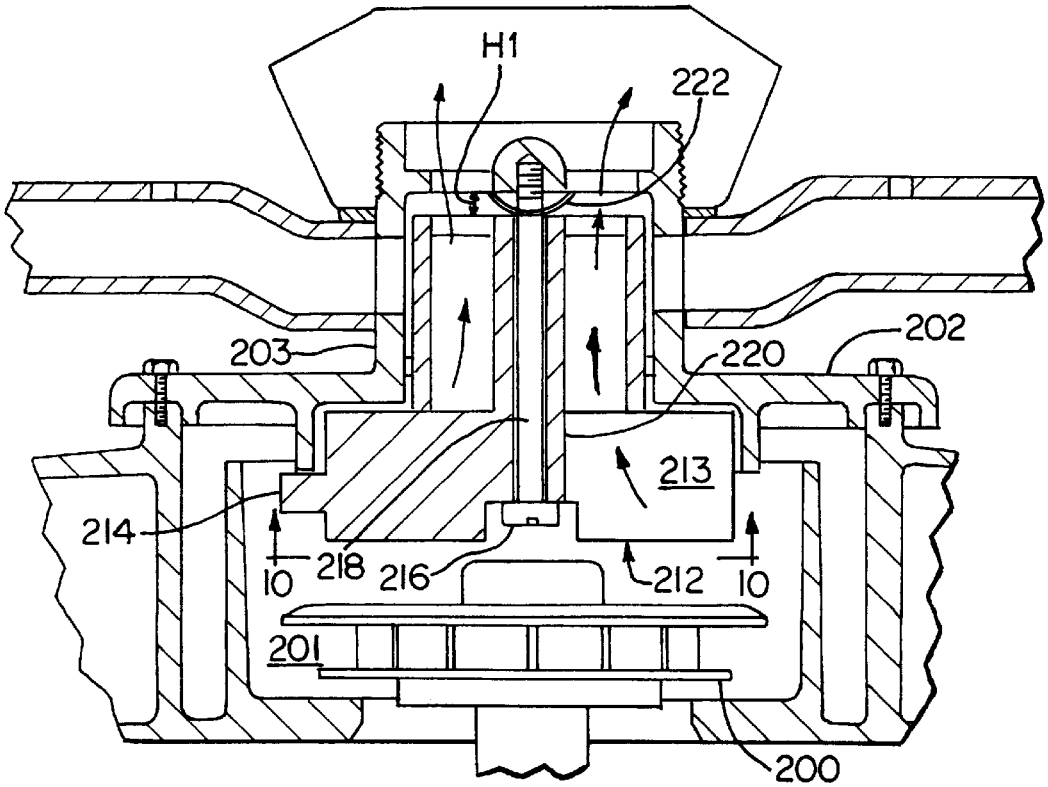
FIG. 9 is a sectional view of the pump system of the third embodiment of the present invention.

FIGS. 8–10 illustrate a third embodiment of the present invention. This embodiment, like the first and second, provides for selectively controlling the flow of wash liquid to the upper and lower spray arms. Many of the components of the third embodiment are substantially similar to the first embodiment. In this embodiment, like the second embodiment, the pump system is configured to be operable in a wash mode when the pump motor is driven in a first direction and operable in a drain mode when the pump motor is driven in a second direction. Accordingly, similar to the pump system of Dingler et al., the pump system includes a pump impeller 200 disposed within a pump chamber 201 and a drain impeller (not shown), supported on a single motor output shaft. In this configuration, therefore, no separate drain pump is required.

The third embodiment includes a cover 202 having a conduit portion 203 including pump outlet openings, similar to the first and second embodiments, for supplying wash liquid to the spray arms. The cover 202 includes a stop 204 and a stop 206 extending from an annular wall 205. A first ratchet tooth 208 and a second ratchet tooth 210 are disposed on the annular wall 205 between the stops 204 and 206. Both ratchet teeth, include a stop surface 208*a* and 210*a*, respectively, and a ramped back surface 208*b* and 210*b*, respectively. As in the first embodiment, a valve body 212 having vanes 213 is received into the conduit portion 203 of the cover 202. The valve body 212 includes openings, similar to the first and second embodiments, for selective alignment with pump outlet openings on the conduit portion 203 of the cover 202.

The valve body 212 is rotatably secured to the cover 202 by a threaded fastener 216. The threaded fastener 216 includes a shank portion 218 which is disposed within a center hub 220 of the valve body 212. The shank portion 218 is slightly longer than the center hub 220 such that the valve body 212 can move axially along the the shank portion 218 a small distance H1. A spring 222 can be provided for biasing the valve body downward, away from the cover 202. The spring 222 may be a helical spring or a wave spring and may be positioned in a plurality of different locations.

Relative rotation of the valve body 212 to the cover 202 is limited by the engagement of a tab 214, extending from the valve body 212, with the stops 204 and 206 and with the first ratchet tooth 208 and the second ratchet tooth 210. The stops and teeth are configured such that the height H2 of the stops 204 and 206 is greater than H1, while the height H3 of the teeth 208 and 210 is less than H1.

The pump is designed such that when the impeller is driven in a first direction 224 the pump recirculates wash liquid within the dishwasher and when the impeller is driven in a second direction 226, the pump drains wash liquid from the dishwasher. During operation, at the beginning of each wash or rinse cycle, the valve body 212 is positioned such that the tab 214 is adjacent the stop 204. Upon energization of the pump in the first direction 224, the valve body 212 is driven in the first direction 224 by the swirling wash liquid in the pump chamber 201. Moreover, the valve body is driven axially upward along the shank portion 218 by the pressure generated in the pump chamber 201. The valve body rotates relative to the cover 202 until the tab 214 contacts the first ratchet tooth 208.

This position with the tab 214 adjacent the ratchet tooth 208 can correspond to a position for aligning selected openings in the cylindrical portion 203 and the valve body 212 for supplying wash liquid to either the upper spray arm, the lower spray arm or to both. In contrast to the first two embodiments, the third embodiment of the present invention, as described herein below, provides for three or more angular orientations, relative to the cover 202, in which the valve body 212 may be positioned. As can be understood by one skilled in the art, with a system having more than two angular positions, one position can be configured to supply wash liquid to the lower spray arm, one position can be configured to supply wash liquid to the upper spray arm, and a third position can be configured to supply wash liquid partially through the openings supplying wash liquid to the upper and lower spray arms such that both spray arms are supplied with wash liquid. Moreover, additional angular positions may be provided for aligning pump outlet openings for supplying wash liquid to various other components such as designated silverware spray nozzles or a filter flushing system.

At a predetermined time, the motor is deenergized, wherein the valve body 212 is urged downward by gravity and by the spring 222. As shown in FIG. 10, in the descended position, the upper edge of the tab 214 is positioned below the bottom edge of the ratchet tooth 208. When the pump is again energized in the first direction 224, the swirling wash liquid drives the valve body 212 in the first direction 224, beyond the first ratchet tooth 208 before the valve body 212 is driven upward by the pressure in the pump chamber 201. In this manner, by deenergizing and reenergizing the pump in the first direction 224, the valve body may be selectively advanced beyond the first ratchet tooth 208.

Rotation of the valve body is subsequently stopped by the tab 214 engaging the second ratchet tooth 210. As discussed above, this position can correspond to a position for aligning selected pump outlets for supplying wash liquid to either the upper spray arm, the lower spray arm or to both.

At a predetermined time, the pump can again be deenergized and reenergized in the first direction 224, allowing the valve body 212 to advance past the second ratchet tooth 210 and rotate until the tab 214 engages the stop 206. As with the previous two positions, this position can be configured to align pump outlet openings such as to provide wash liquid to the upper spray arm, lower spray arm or both.

When the pump is driven in the second direction 226 for draining the wash liquid from the dishwasher tub, the valve body 212 is driven in the second direction 226 and the valve body is driven axially upward along the shank portion 218 by the pressure generated in the pump chamber 201. However, rather than stopping at the ratchet teeth 208 and 210, as when rotated in the first direction 224, the tab 214 rides up and over the ramped surfaces 210*b* and 208*b* until engaging the stop 204. In this manner, during drain, the valve body 212 is repositioned in a home orientation wherein the tab 214 is adjacent the stop 204. In this home position, all openings to the spray arms can be closed such that not wash liquid flows through the spray arms during drain thereby preventing soil redeposition on the dishes.

The third embodiment, therefore, provides a ratchet type mechanism which allows the angular position of the valve body 212 relative to the cover 202 to be controlled among three or more positions. The different angular positions of the valve body 212 can correspond to alignment of openings for alternatively supplying wash liquid to either the top spray arm, the bottom spray arm or both spray arms. Selective control of the wash liquid recirculating can be achieved by energizing and deenergizing the wash pump, as described above.

The inventors of the present invention have contemplated that multiple angular position control of the valve body, as provided in the third embodiment, could be achieved using a system of sequential, movable stops interconnected through linkages and diaphragms to electromechanical actuation devices such as wax motors or solenoid. The stops could be positioned to engage the valve body or could be retracted by the electromechanical devices. In this fashion, through operation of the electromechanical devices, the angular position of the valve body could be controlled. This alternative structure is encompassed by the appended claims.

As shown and described, the first three embodiments of the present invention provide a system for alternatively supplying wash liquid to either the upper or lower spray arms. In this manner, the total flow requirements for operating the dishwasher may be reduced such that less hot water is required thereby reducing the energy usage of the dishwasher. Moreover, the directing of wash liquid to either spray arm may be selectively controlled. Selective control of the which spray arm receives wash liquid offers many advantages. Primary among these is the opportunity to direct wash liquid to just one dishrack during an entire dishwasher cycle. This offers the user the advantage of efficiently washing smaller loads of dishes placed onto only one rack. This cycle feature may be highly desirable to people with relatively small dishwasher load requirements such as single person households. Still further, selective control of the recirculation of wash liquid within the dishwasher allows for the optimum sequence of alternating the supply of wash liquid to the upper or lower spray arm.

A fourth embodiment is also contemplated by the inventors. In this embodiment, the direction of the wash impeller and the resultant rotational direction of the swirling wash liquid is used to operate a valve for controlling wash liquid flow. This improvement is preferably provided as an improvement to a reversible direction pump wherein in the first pump direction wash liquid is supplied to the spray arms and in a second direction the pump drains the dishwasher and the valve prevents wash liquid flow to the spray arms.

Figure 11:
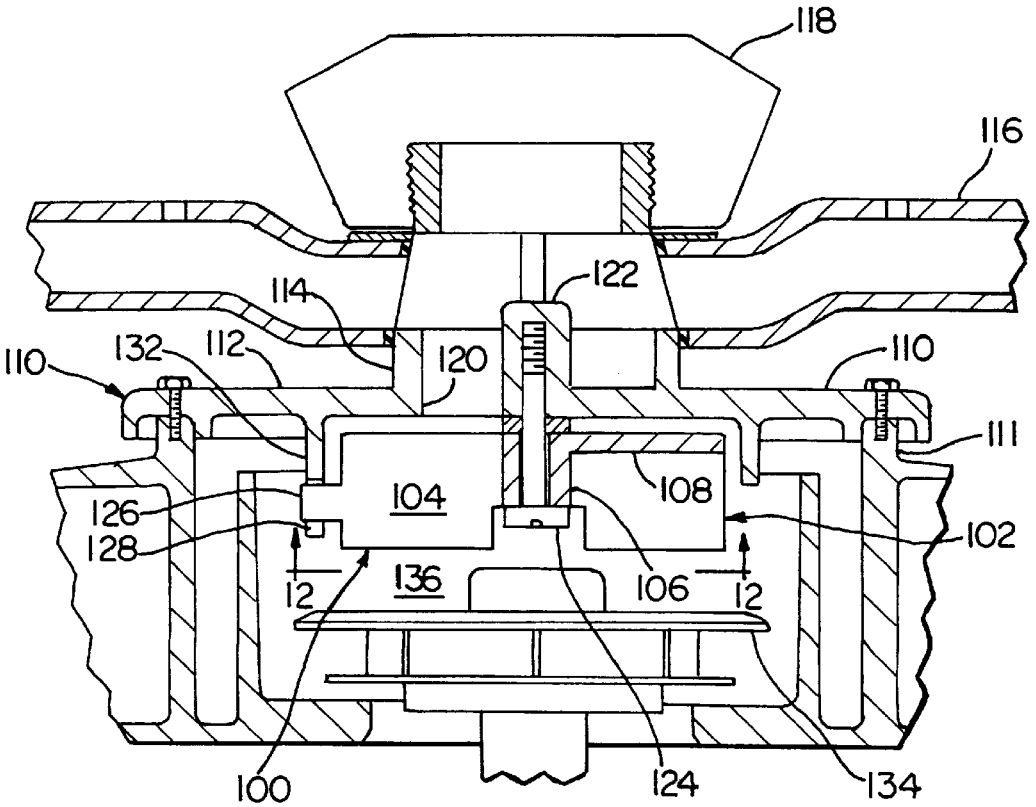
FIG. 11 is a sectional view of a fourth embodiment of the present invention.
Figure 12:
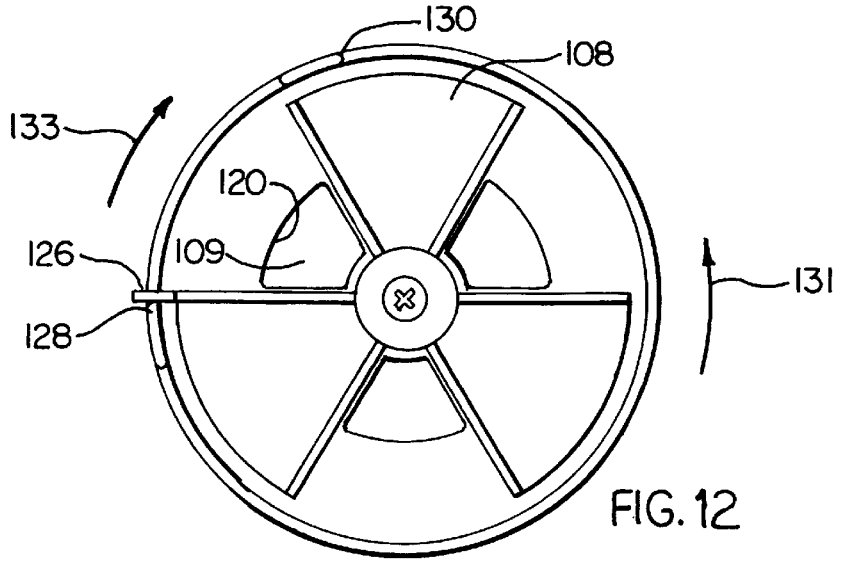
FIG. 12 is a view, taken along line 12—12 of FIG. 11.

Accordingly, in FIGS. 11 and 12, the details of the fourth embodiment are shown. A flow director or diffuser assembly 100 includes a valve body 102 having a plurality of vanes 104 extending radially outwardly and downwardly from a center hub 106. Web portions 108 extend between alternating vanes 104 such that the valve is provided with alternating open sectional portions 109 between the vanes 104.

The valve body 102 is supported for limited rotational movement by a cover 110 which is secured to the top of a pump housing 111. The cover 110 includes a flat annular portion 112 and a conduit portion 114. A lower spray arm 116 is disposed about the conduit portion 114 and is rotatably secured in position by an upper spray arm feed boot 118, which threadingly engages the top of the conduit portion 114. The conduit portion 114 of the cover 110 is provided with openings 120, alternatingly positioned about a center boss 122.

The valve body 102 is rotatably secured to the cover 110 by a threaded fastener 124, such as a shoulder screw, which extends through a bore hole in the center hub 106 and screws into the center boss 122. Rotation of the valve body 102 relative to the cover 110, however, is limited by the interference between a tab 126, extending from one of the vanes 104, and stops 128 and 130, provided on an annular wall 132 downwardly extending from the cover 110. The valve body 102 may rotate, therefore, between a first position where tab 126 engages stop 128 and a second position where tab 126 engages stop 130.

During operation, a pump motor (not shown) can be controlled to drive an impeller 134 in a first direction 131, creating a clockwise swirling action of wash liquid within the pump chamber 136. The vanes 104 of the valve body 102 extend into the pump chamber 136 and, responsive to the swirling action of the wash liquid, rotate the valve body 104 in the first direction 131 until tab 126 engages stop 128. As illustrated in FIGS. 11 and 12, when the valve body 102 is rotated until the tab 126 is adjacent the stop 128, the open sectional portions 109 on the valve body 102 align with the openings 120 of the cover 100. In this fashion, during rotation of the pump impeller 134 in the first direction 131, wash liquid is supplied, under the positive pressure generated by the vanes 104, through openings 109 and 120 to the spray arm 116.

Reversing the direction of the pump motor and driving the pump impeller 134 in a second direction 133 results in a counter-clockwise swirling of wash liquid in the pump chamber. Responsive to the counter-clockwise swirling of wash liquid, the vanes 104 drive the valve body 102 counter-clockwise until tab 126 engages stop 130. In this position, the open sectional portions 109 of the valve body 102 do not align with the openings 120 of the cover. In this fashion, during rotation of the pump impeller 134 in the second direction 133, wash liquid is prevented from being supplied to the spray arms. Accordingly, during rotation of the pump impeller 134 in the second direction 133, a drain impeller (not shown) operates to drain wash liquid from the dishwasher while the wash liquid is prevented from recirculating over the dishes, thereby preventing the above described soil redeposition problem.

Figure 13:
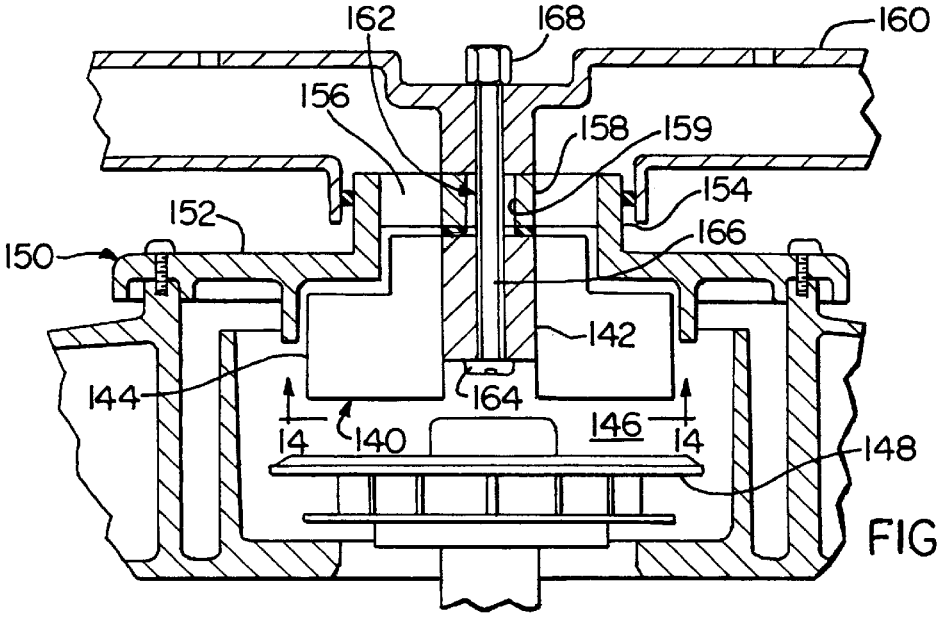
FIG. 13 is a sectional view of a fifth embodiment of the present invention.
Figure 14:
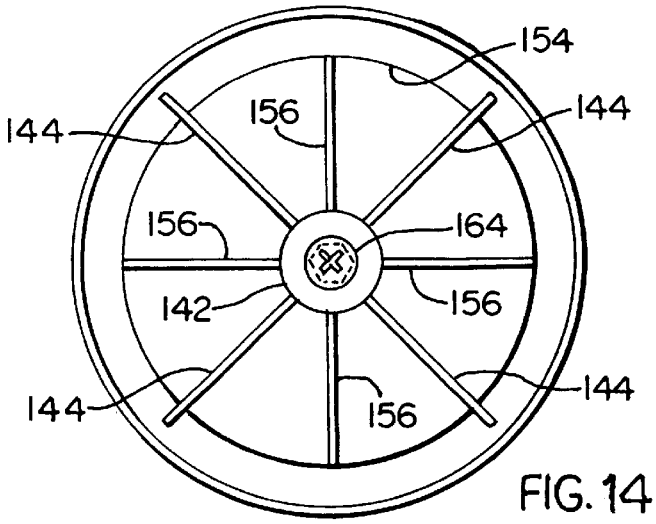
FIG. 14 is a view taken along lines 14—14 of FIG. 13.

FIGS. 13 and 14 illustrate a fifth embodiment of the present invention. In this embodiment, the dishwasher spray arm rotation is controlled by the rotational direction of the pump. This embodiment contemplates a reversible pump wherein the pump operates in a wash mode in both directions. A separate drain pump desired.

Accordingly, a diffuser member 140 is provided having a center hub 142 and vanes 144 extending radially outward from the center hub 142. The vanes 144 extend into a pump chamber 146 and operate to convert the rotational direction of the swirling wash liquid, driven by a pump impeller 148, into a positive pressure.

The diffuser member 140 is disposed below a pump cover 150. The cover 150 includes a flat annular portion 152 and a conduit portion 154. The conduit portion 154 is provided with a plurality of radial ribs 156 extending inwardly toward a center hub 158 having a center bore 159. A spray arm 160 is supported above the cover 150 and receives fluid flow through the conduit portion 154 of the cover.

The diffuser member 140 is drivingly interconnected to the spray arm 160 by a drive member or bolt 162. The drive bolt 162 includes a head 164 and a main body portion 166 extending through the center hub 142, the center bore 159 and the spray arm 160. A nut 168 may be secured to a threaded end of the drive bolt 162 extending through the spray arm 160. The main body portion 166 of the drive bolt 162 is splined or includes a flat or other suitable features for transferring torque and engages the center hub 142 and the spray arm 160 such that the diffuser member 140 and spray arm are rotationally secured together.

During operation, when the pump is operated in a first clockwise direction, the diffuser converts the rotating fluid in the pump chamber 146 into a positive pressure and supplies this pressure to the spray arm. Additionally, the rotating fluid applies a torque to the diffuser, causing the diffuser 140 and spray arm 160 to rotate in a clockwise direction. Due to the frictional drag of the diffuser 140 and spray arm 160, while the rotating fluid in the pump chamber 146 may rotate at speeds greater than 200 RPM, the spray arm is rotated much more slowly, preferably between 20–50 RPM. Correspondingly, when the pump is reversed and driven in a counter-clockwise direction, the spray arm 160 is driven in a counter-clockwise direction.

In this fashion, the direction of the spray arm rotation may be reversed by reversing the direction of the pump impeller rotation. Moreover, the spray arm nozzle configuration may be optimally designed for wash performance with no need to configure the spray arm nozzles to provide reactive force to rotate the spray arm.

Although the present invention has been described with reference to a specific embodiment, those of skill in the Art will recognize that changes may be made thereto without departing from the scope and spirit of the invention as set forth in the appended claims.

We claim:

1. In a dishwasher having a wash cavity for receiving dishes, a fluid recirculation system operable in a wash mode comprising:

a pump chamber disposed at the bottom of said wash cavity, said pump chamber having an outlet;

a pump impeller in said pump chamber for drawing wash liquid into and discharging wash liquid from said pump chamber, said pump impeller imparting a rotational motion to the wash liquid disposed in said pump chamber;

a rotatable diffuser disposed at said pump chamber outlet for selectively controlling fluid recirculation within said wash cavity responsive to the rotational motion of the wash liquid;

said pump impeller has a rotational axis; and said rotatable diffuser converts the rotational motion of said wash liquid to a translational motion along the rotational axis of said pump impeller.

2. The fluid recirculation system according to claim 1, further wherein said rotatable diffuser comprises a valve disposed at said pump chamber outlet for selectively closing said pump outlet opening in response to the pump impeller direction of rotation.

3. The fluid recirculation system according to claim 1, further comprising:

a wash arm device fluidly interconnected with said pump chamber for spraying wash liquid onto said dishes disposed in the wash chamber; and wherein said rotatable diffuser includes a vane extending into said pump chamber for directing wash liquid to said wash arm, said rotatable diffuser being inter-connected to said wash arm and imparting a rotation to the wash arm in response to the rotating action of the wash arm such that when said pump impeller is rotated in a first direction said wash arm rotates in a like direction and when said pump impeller is rotated in a second direction, said wash arm rotates in a like second direction.

4. In a dishwasher having a wash cavity for receiving dishes and an upper dishrack and a lower dishrack supported in said wash cavity, a fluid recirculation system operable in a wash mode comprising:

a pump chamber disposed at the bottom of said wash cavity, said pump chamber having an outlet;

a pump impeller in said pump chamber for drawing wash liquid into and discharging wash liquid from said pump chamber, said pump impeller imparting a rotational motion to the wash liquid disposed in said pump chamber;

a rotatable diffuser disposed at said pump chamber outlet for selectively controlling fluid recirculation within said wash cavity responsive to the rotational motion of the wash liquid;

a first spray device fluidly interconnected with said pump chamber for spraying wash liquid toward said lower rack;

a second spray device fluidly interconnected with said pump chamber for spraying wash liquid toward said upper rack; and wherein said rotatable diffuser includes a valve having a vane extending into said pump chamber, said valve selectively supplying wash liquid to either said first wash arm or said second wash arm responsive to said pump impeller rotation.

5. The fluid recirculation system of claim 4, further comprising:

a pump cover disposed above said pump chamber, said pump cover forming a top wall of said pump chamber, said pump cover further including an opening for forming an outlet for said pump chamber; and wherein said valve is rotatably supported by said pump cover adjacent said opening.

6. The fluid recirculation system of claim 4, further wherein said valve is rotatable between a first angular position and a second angular, said valve rotates between said first and second position for selectively directing wash liquid to said first spray device or said second spray device in response to the direction of said pump impeller rotation.

7. The fluid recirculation system of claim 6, further wherein said valve comprises:

a valve body having a first opening and a second opening, said valve body being disposed in said outlet, and a plurality of vanes extending from said valve body into said pump chamber, wherein said valve is rotatably supported for rotational movement between a first angular position and a second angular position in response to the rotational direction of said pump impeller such that in said first angular position wash liquid is supplied to said first spray device through said first opening and not to said second spray device and in said second angular position wash liquid is supplied to said second spray device through said second opening and not to said first spray device.

8. The fluid recirculation system of claim 4, further comprising:

means for controlling said valve to direct wash liquid to either said first spray device or said second spray device responsive to the rotational speed of said pump impeller.

9. The fluid recirculation system of claim 4, further comprising:

a spring for biasing said valve to direct wash liquid to said second spray device;

a variable speed motor drivingly interconnected with said pump impeller wherein said variable speed motor may drive said pump impeller to overcome said spring bias and move said valve to direct wash liquid to said first spray device.

10. The fluid recirculation system of claim 4, further wherein said valve includes:

a valve body having a first opening and a second opening, said valve body being disposed at said outlet, and a plurality of vanes extending from said valve body into said pump chamber, wherein said valve is rotatably supported for rotational movement between a first angular position and a second angular position, in said first position wash liquid is supplied to said first spray device through said first opening and in said second position wash liquid is supplied to said second spray device through said second opening; and further comprising:

a variable speed motor drivingly interconnected with said pump impeller; and a spring for biasing said valve toward said second angular position such that at a first motor speed said valve is positioned in said second angular position and at a second, higher motor speed the torque applied to the plurality of vanes by the rotating wash liquid overcomes the spring bias and said valve is positioned in said first angular position.

11. The fluid recirculation system of claim 4; further comprising:

means for selectively controlling the angular position of said valve between at least three angular orientations.

12. The fluid recirculation system of claim 4, further comprising:

a pump cover disposed above said pump chamber, said pump cover forming a top wall of said pump chamber and having an opening for forming an outlet for said pump chamber, said pump cover including:

a first stop extending into said pump chamber, and a first ratchet tooth extending into said pump chamber; and wherein said valve is rotatably supported about an axis by said pump cover adjacent said opening, said valve can move translationally along said axis a predetermined distance and further has a tab for engaging said first stop or said first ratchet tooth wherein selective rotation of said pump impeller positions said valve in a first angular orientation or in a second angular orientation.

13. The fluid recirculation system of claim 12; further comprising:

a second ratchet tooth extending into said pump chamber from said pump cover;

a second stop extending from said pump cover, said first ratchet tooth and said second ratchet tooth being disposed between said first second stop; and wherein selective rotation of said pump impeller positions said valve such that said tab abuts said first ratchet tooth, said second ratchet tooth or said second stop wherein said valve can be selectively positioned in said first angular orientation, said second orientation, or in a third angular orientation.

14. The fluid recirculation system of claim 12, further wherein:

said pump impeller is rotatable in a first and second direction;

said ratchet tooth has a stop surface and a ramped back surface such that in said first direction of impeller rotation, said valve is driven such that said tab engages said stop surface and in said second direction of impeller rotation, said valve is driven such that said tab rides up said ramped back surface past said ratchet tooth.

15. A dishwasher for washing dishes, comprising:

a wash cavity adapted to hold dishes for washing;

a reversible pump disposed at the bottom of said wash cavity, said reversible pump having a pump impeller;

a first spray device fluidly interconnected with said pump for spraying wash liquid in said wash cavity;

a second spray device fluidly interconnected with said pump for spraying wash liquid in said wash cavity; and means for selectively directing the flow of wash liquid from said pump to either said first wash arm or said second wash arm in response to said pump impeller rotation.

16. The dishwasher according to claim 15, further comprising:

means for selectively directing the flow of wash liquid from said pump to either said first wash arm or said second wash arm in response to the direction of said pump impeller rotation.

17. The dishwasher according to claim 15, further comprising:

means for selectively directing the flow of wash liquid from said pump to either said first wash arm or said second wash arm in response to the speed of said pump impeller rotation.

18. The dishwasher according to claim 15, further comprising:

means for selectively directing the flow of wash liquid from said pump to either said first wash arm or said second wash arm in response to selectively energizing and deenergizing said pump.

19. A dishwasher for washing dishes, comprising:

a wash cavity adapted to hold dishes for washing;

a pump fluidly connected to the wash cavity for circulating a wash liquid in the wash cavity;

a spray device fluidly connected to the pump for spraying a wash liquid in the wash cavity;

a conduit having multiple outlets extending between the pump and the spray device to fluidly connect the pump and spray device; and a rotatable flow director having a body disposed within the conduit for directing the flow of the wash liquid circulated by the pump along the body toward at least one of the multiple outlets.

20. The dishwasher according to claim 19, wherein the flow director has vanes for directing the flow of the wash liquid.

21. The dishwasher according to claim 19, wherein the body further comprises a valve for controlling the flow of a wash liquid through the conduit.

22. The dishwasher according to claim 21, wherein the valve comprises a valve body having an open end facing the pump and a valve opening which can be fluidly connected and disconnected to the spray device by the rotation of the valve body between a first rotational position and a second rotational position.

23. The dishwasher according to claim 22, wherein vanes radially extending from the valve body to deflect a wash liquid toward the spray device.

24. The dishwasher according to claim 22, wherein:

the conduit has a conduit opening fluidly connecting the conduit to the spray device; and the valve opening is positioned on the valve body so that in a first rotational position the valve opening is aligned with the conduit opening to permit wash liquid flow from the pump into the spray device and in a second rotational position the valve opening is not aligned with the conduit opening to prohibit fluid flow from the pump into the spray device.

25. The dishwasher according to claim 24, wherein the pump is reversible and further comprises an impeller for pumping a wash liquid which imparts a rotational motion to the liquid flow corresponding to the direction of rotation of the impeller such that when the impeller is rotated in a first direction, there is a corresponding rotation of the wash liquid and the valve body is rotated to the first rotational position, and when the impeller is rotated in a second, reverse direction, there is a corresponding rotation of the wash liquid and the valve body is rotated to the second rotational position.

26. A dishwasher for washing dishes, comprising:

a wash cavity adapted to hold dishes for washing;

a pump fluidly connected to the wash cavity for circulating a wash liquid in the wash cavity;

a spray device fluidly connected to the pump for spraying a wash liquid in the wash cavity;

a conduit extending between the pump and the spray device to fluidly connect the pump and spray device;

a rotatable flow director having an axis of rotation being provided within the conduit between the pump and the spray device for directing the flow of the wash liquid circulated by the pump along the axis of rotation toward the spray device; and the pump further comprises an impeller for imparting a rotational motion to a wash liquid and the flow director converts the rotational motion of the wash liquid to a translational motion along the axis of rotation to direct the wash liquid from the pump toward the spray device.

27. A dishwasher for washing dishes, comprising:

wash cavity adapted to hold dishes for washing;

a pump fluidly connected to the wash cavity for circulating a wash liquid in the wash cavity;

a spray device fluidly connected to the pump for spraying a wash liquid in the wash cavity;

a conduit extending between the pump and the spray device to fluidly connect the pump and spray device;

a rotatable flow director having an axis of rotation being provided within the conduit between the pump and the spray device for directing the flow of the wash liquid circulated by the pump along the axis of rotation toward the spray device; and a soil separator for removing soil particles from a wash liquid and the conduit is defined at least in part by the soil separator.

28. A dishwasher for washing dishes, comprising:

a wash cavity adapted to hold dishes for washing;

a pump fluidly connected to the wash cavity for circulating a wash liquid in the wash cavity;

a spray device fluidly connected to the pump for spraying a wash liquid in the wash cavity;

a conduit extending between the pump and the spray device to fluidly connect the pump and spray device;

a rotatable flow director having an axis of rotation being provided within the conduit between the pump and the spray device for directing the flow of the wash liquid circulated by the pump along the axis of rotation toward the spray device; and the spray device is a rotatable arm having a hollow core fluidly connected to the conduit and further having multiple openings extending from the core through the arm to spray a wash liquid throughout the wash cavity.

29. A dishwasher for washing dishes, comprising:

wash cavity adapted to hold dishes for washing;

a pump fluidly connected to the wash cavity for circulating a wash liquid in the wash cavity;

a spray device fluidly connected to the pump for spraying a wash liquid in the wash cavity;

a conduit extending between the pump and the spray device to fluidly connect the pump and spray device, said conduit having a conduit opening fluidly connecting the conduit to the spray device;

a second spray device fluidly connected to the conduit;

the conduit has a second conduit opening fluidly connecting the conduit to the second spray device;

a rotatable flow director having an axis of rotation provided within the conduit between the pump and the spray device for directing the flow of the wash liquid circulated by the pump along the axis of rotation toward the spray device;

said flow director comprising a valve for controlling the flow of a wash liquid through the conduit;

the valve comprising a valve body having an open end facing the pump and a valve opening which can be fluidly connected and disconnected to the spray device by the rotation of the valve body between a first rotational position and a second rotational position;

the valve body has a second valve opening for fluidly connecting the second spray device to the conduit upon the rotation of the valve body; and the first valve opening and the second valve opening being positioned on the body so that in the first rotational position the first valve opening is aligned with the first conduit opening, permitting liquid flow to the first spray device, and the second valve opening is not aligned with the second conduit opening, preventing the flow of liquid into the second spray device, and in the second rotational position the second valve opening is aligned with the second conduit opening, permitting liquid flow to the second spray device, and the first valve opening is not aligned with the first conduit opening, preventing the flow of liquid into the first spray device.

30. The dishwasher according to claim 29, wherein the pump is reversible and further comprises an impeller for pumping a wash liquid and which imparts a rotational motion to a liquid flow corresponding to the direction of rotation of the impeller thereby when the impeller is rotated in a first direction, there is a corresponding rotation of the wash liquid and the valve body is rotated to the first rotational position, and when the impeller is rotated in a second, reverse direction, there is a corresponding rotation of the wash liquid and the body is rotated to the second rotational position.

31. The dishwasher according to claim 30, wherein the conduit has a stop arm extending into the path of rotation of at least one of the vanes thereby stopping the body in the first rotational position when the pump is operated in the first direction and stopping the body in the second rotational position when the pump is operated in the second direction.

32. The dishwasher according to claim 30, wherein the conduit has two stop arms and one of the vanes has a radially extending stop tab, the stop arms extending into the path of rotation of the stop tab, when the valve body is in the first rotational position, the stop tab abuts one of the stop arms and when the body is in the second rotational position, the stop tab abuts the other of the stop arms.

33. The dishwasher according to claim 29, wherein:

the pump is a variable speed pump operable at first speed and a second speed faster than the first speed, the pump further comprises an impeller for pumping a wash liquid and which imparts a rotational motion to a liquid flow corresponding to the direction of rotation of the impeller;

and further comprising:

a biasing device applying torque to the body opposite the direction of rotation of the impeller, the torque being greater than the force of a fluid acting on the vanes when the pump is operated at the first speed to prevent the rotation of the valve body and the movement of the valve body toward the first rotational position, and the torque is less than the force of a fluid acting on the vanes when the pump is operated at the second speed to permit the rotation of the valve body and the movement of the body to the second rotational position.

34. The dishwasher according to claim 33, wherein the conduit has a stop arm extending into the path of rotation of at least one of the vanes thereby stopping the body in the first rotational position when the pump is operated in the first direction and stopping the body in the second rotational position when the pump is operated in the second direction.

35. The dishwasher according to claim 33, wherein the conduit has two stop arms and one of the vanes has a radially extending stop tab, the stop arms extending into the path of rotation of the stop tab, when the valve body is in the first rotational position, the stop tab abuts one of the stop arms and when the body is in the second rotational position, the stop tab abuts the other of the stop arms.

36. A dishwasher for washing dishes, comprising:

a wash cavity adapted to hold dishes for washing;

a pump fluidly connected to the wash cavity for circulating a wash liquid in the wash cavity;

a spray device fluidly connected to the pump for spraying a wash liquid in the wash cavity;

a conduit extending between the pump and the spray device t fluidly connect the pump and spray device;

a rotatable flow director having an axis of rotation being provided within the conduit between the pump and the spray device for directing the flow of the wash liquid circulated by the pump along the axis of rotation toward the spray device; and a second spray device fluidly connected to the pump for spraying wash liquid in the wash cavity;

a first stop extending from the conduit;

a first ratchet tooth extending from the conduit; and wherein the rotatable flow director is movable a predetermined distance along the axis of rotation, the flow director further includes a valve and a tab for selectively engaging the first stop or the first ratchet tooth such that the valve may be selectively positioned in a first angular orientation or a second angular orientation.

37. The fluid recirculation system of claim 36, further comprising:

a second ratchet tooth extending from the conduit;

a second stop extending from the conduit, the first and second ratchet teeth are disposed between the first second stop; and wherein the pump may be selectively energized to spray wash liquid in said wash cavity and selectively rotate the valve such that the tab abuts the first ratchet tooth, the second ratchet tooth or the second stop wherein the valve is selectively positioned in the first angular orientation, the second orientation, or in a third angular orientation.

38. The fluid recirculation system of claim 36, further wherein:

the pump has a impeller which is rotatable in a first and second direction;

the ratchet tooth has a stop surface and a ramped back surface such that in the first direction of impeller rotation, the valve is driven such that the tab engages the stop surface and in the second direction of impeller rotation, the valve is driven such that the tab rides up the ramped back surface past the ratchet tooth.

* * * * *